US008955531B2

(12) United States Patent
Hou et al.

(10) Patent No.: US 8,955,531 B2
(45) Date of Patent: Feb. 17, 2015

(54) HIGH PRESSURE WATER CLEANER WITH DETACHABLE WATER TANK

(75) Inventors: James S. T. Hou, Toronto (CA); Simon Treadwell, Toronto (CA); Ming Liu, Toronto (CA)

(73) Assignee: Active Products International Limited, Hong Kong (CN)

( * ) Notice: Subject to any disclaimer, the term of this patent is extended or adjusted under 35 U.S.C. 154(b) by 793 days.

(21) Appl. No.: 13/155,362

(22) Filed: Jun. 7, 2011

(65) Prior Publication Data

US 2012/0312340 A1 Dec. 13, 2012

(51) Int. Cl.
*B05B 9/043* (2006.01)
*B08B 3/02* (2006.01)

(52) U.S. Cl.
CPC ..... *B05B 9/043* (2013.01); *B08B 3/026* (2013.01)
USPC ..... 134/198

(58) Field of Classification Search
CPC ..... B08B 3/026; B05B 9/043
USPC ..... 134/198
See application file for complete search history.

(56) References Cited

U.S. PATENT DOCUMENTS

| | | | | |
|---|---|---|---|---|
| 5,533,671 | A * | 7/1996 | Baer | 239/10 |
| 5,762,411 | A * | 6/1998 | Yemini | 312/290 |
| 6,158,673 | A * | 12/2000 | Toetschinger et al. | 239/305 |
| 7,556,210 | B2 * | 7/2009 | Mandell et al. | 239/158 |
| 2009/0173753 | A1 * | 7/2009 | Conner et al. | 222/333 |
| 2012/0241014 | A1 * | 9/2012 | Wise | 137/13 |

* cited by examiner

*Primary Examiner* — Michael Barr
*Assistant Examiner* — Spencer Bell
(74) *Attorney, Agent, or Firm* — Bhole IP Law

(57) ABSTRACT

A high pressure water cleaner with detachable water tank includes a water cleaner main unit having an internal hydraulic pump, a top receptacle and a feed water connector in the receptacle in communication with the hydraulic pump, and a water tank detachably insertable into the receptacle and lockable to the receptacle by a movable lock. Thus, the water cleaner main unit and the water tank can be used together or separately subject to different application requirements.

18 Claims, 8 Drawing Sheets

HIGH PRESSURE WATER CLEANER WITH DETACHABLE WATER TANK

BACKGROUND OF THE INVENTION (a) Field of the Invention

The present invention relates to water cleaners and more particularly to a high pressure water cleaner with detachable water tank comprising a water cleaner main unit, a detachable water tank.

(b) Description of the Prior Art

When using a conventional high pressure water cleaner, the operator will encounter the following two problems in most cleaning situations. One is that there is no water tap available or it is restrictive to connect a hose to a water tap. In this case, the high pressure water cleaner becomes useless. The other problem is that it is impossible to achieve a satisfactory cleaning effect just by using high pressure water cleaner only. For example, when cleaning car tires, car internals, motorcycles or machine, it is required to use extra cleaning hand tools (such as towels, brushes, etc.) to perform a further cleaning work.

The present invention provides an efficient solution to the conventional water cleaner problems described above: a detachable tank not only provides water to the cleaner directly without extra water source, but also provides a place to wet and wash hand cleaning tools as well. Meanwhile, the water cleaner also can perform normal high pressure cleaner job individually by connecting to a tap water, and the water tank could be used as a conventional water bucket when detached from the cleaner.

The similar products in the market currently have two features, one is a pressure washer plus a separated bucket, it can't work without tap water; another one is a pressure washer with an integrated tight tank. Although the tight tank could supply water to keep the cleaner working, it only could work under low pressure (under 300 psi), low voltage (12V DC), and since it cannot work under real high pressure, it couldn't achieve good cleaning performance.

SUMMARY OF THE INVENTION

The present invention has been accomplished under the circumstances in view. According to one aspect of the present invention, the high pressure water cleaner with detachable water tank comprises a high pressure cleaner main unit, a detachable water tank and other accessories. Thus, the user can connect the water cleaner main unit to a water source by a hose for application. Alternatively, the user can use the water tank to take water or other cleaning solution and then attach the water tank to the water cleaner main unit to provide water or the cleaning solution to the water cleaner main unit for application. Therefore, a high pressure water cleaner with detachable water tank satisfies different application requirements.

According to another aspect of the present invention, the water cleaner main unit comprises a movable lock for locking the water tank to a receptacle. When the movable lock is unlocked from the water tank, the water tank can be separated from the water cleaner main unit.

According to another aspect of the present invention, the water tank has a check valve located on the bottom side. When the water tank is inserted into the receptacle of the water cleaner main unit, the check valve is connected to a feed water connector in the receptacle of the water cleaner main unit and opened for letting water or other cleaning solution flow into the water cleaner main unit for application. When the water tank is separated from the water cleaner main unit, the check valve is closed, avoiding water leakage.

According to still another aspect of the present invention, the water tank has rest means for the resting of the nozzle gun that is connected to the water cleaner main unit.

According to still another aspect of the present invention, the water tank and the water cleaner main unit are configured to fit each other so that the water tank can be easily inserted into the receptacle of the water cleaner main unit and positively positioned in position, and conveniently separated from the water cleaner main unit.

DETAILED DESCRIPTION OF THE PREFERRED EMBODIMENTS

Figure 1:
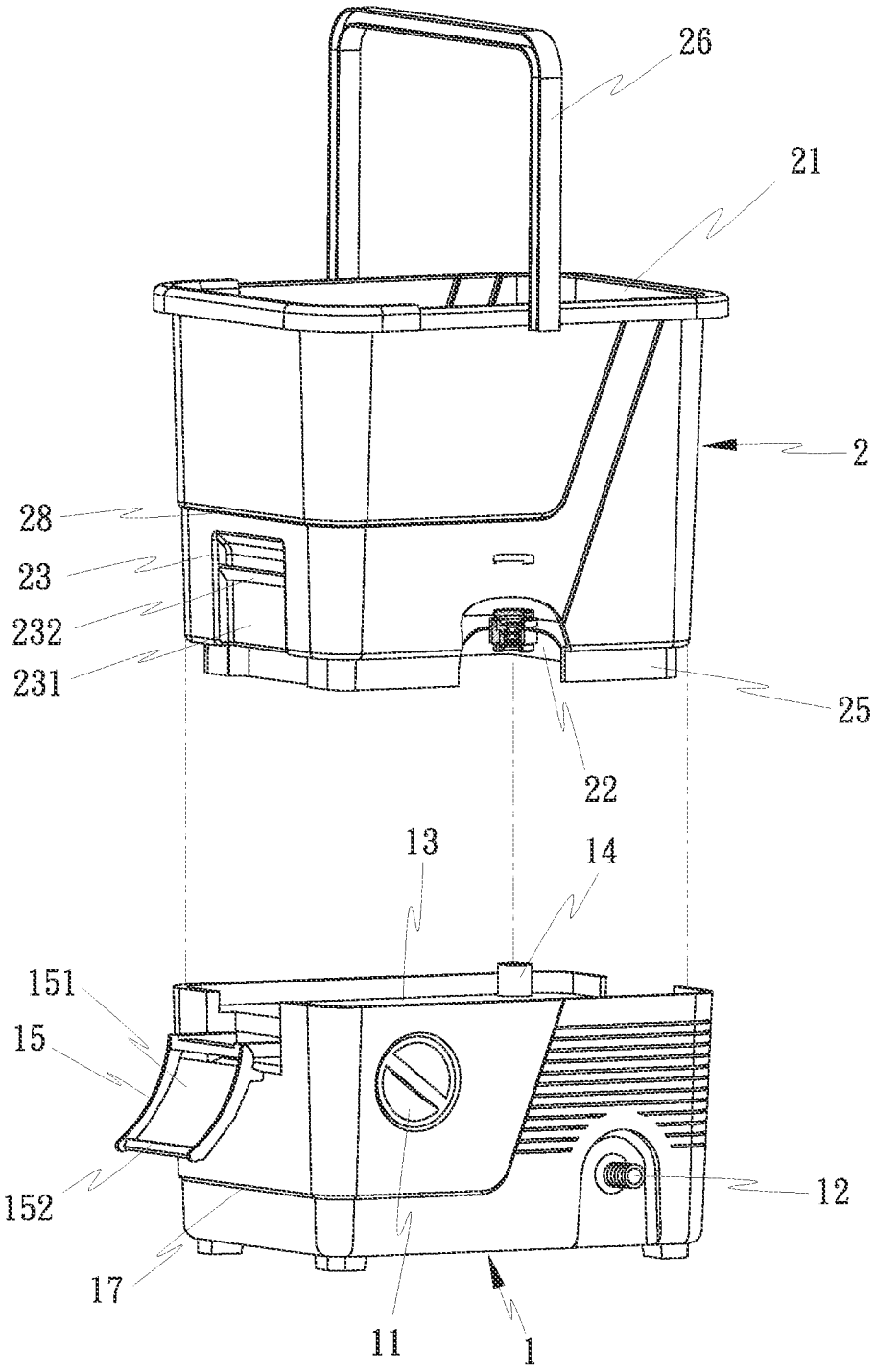
FIG. 1 illustrates a split status of the high pressure water cleaner with detachable water tank high pressure water cleaner with detachable water tank in accordance with the present invention.
Figure 2:
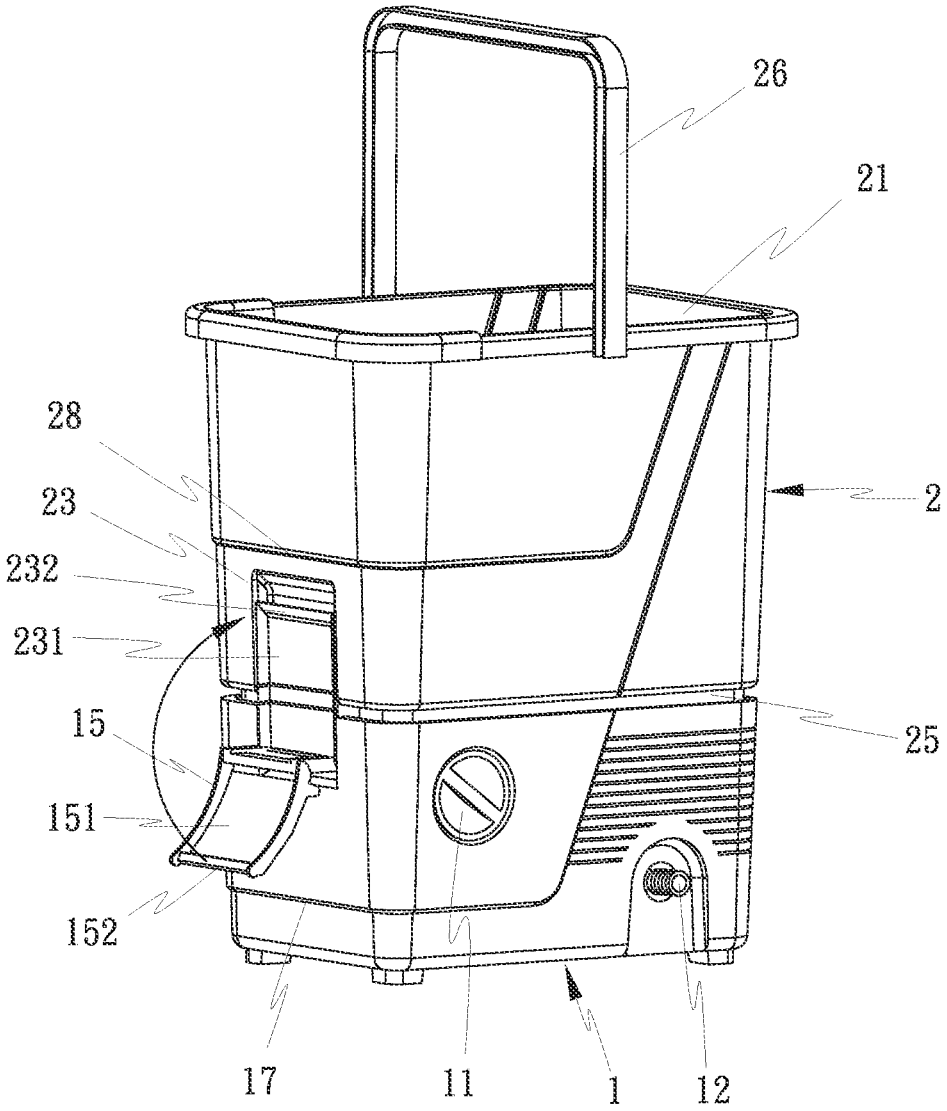
FIG. 2 is an elevational assembly view of the high pressure water cleaner with detachable water tank in accordance with the present invention.

As shown in FIGS. 1 and 2, the high pressure water cleaner with detachable water tank in accordance with the present invention comprises a water cleaner main unit 1 and a detachable water tank 2.

The water cleaner main unit 1 can be made in any of a variety of shapes. According to this embodiment, the water cleaner main unit 1 has a rectangular shape. The water cleaner main unit 1 comprises a hydraulic pump (not shown) mounted on the inside and adapted for enhancing the pressure of supplied water, a regulator 11 for regulating water pressure and water flow rate and an electrical drive (not shown) for driving the hydraulic pump. The water cleaner main unit 1 has a water outlet 12 disposed at one lateral side thereof in communication with the internal hydraulic pump for the connection of a spray gun, a receptacle 13 located on the top side thereof for receiving the detachable water tank 2, a feed water connector 14 upwardly protruding from the bottom wall of the receptacle 13 and disposed in communication with the internal hydraulic pump, and a movable lock 15 adapted for locking the detachable water tank 2 to the receptacle 13. Thus, the detachable water tank 2 can be detachably secured to the receptacle 13 of the water cleaner main unit 1.

Figure 8:
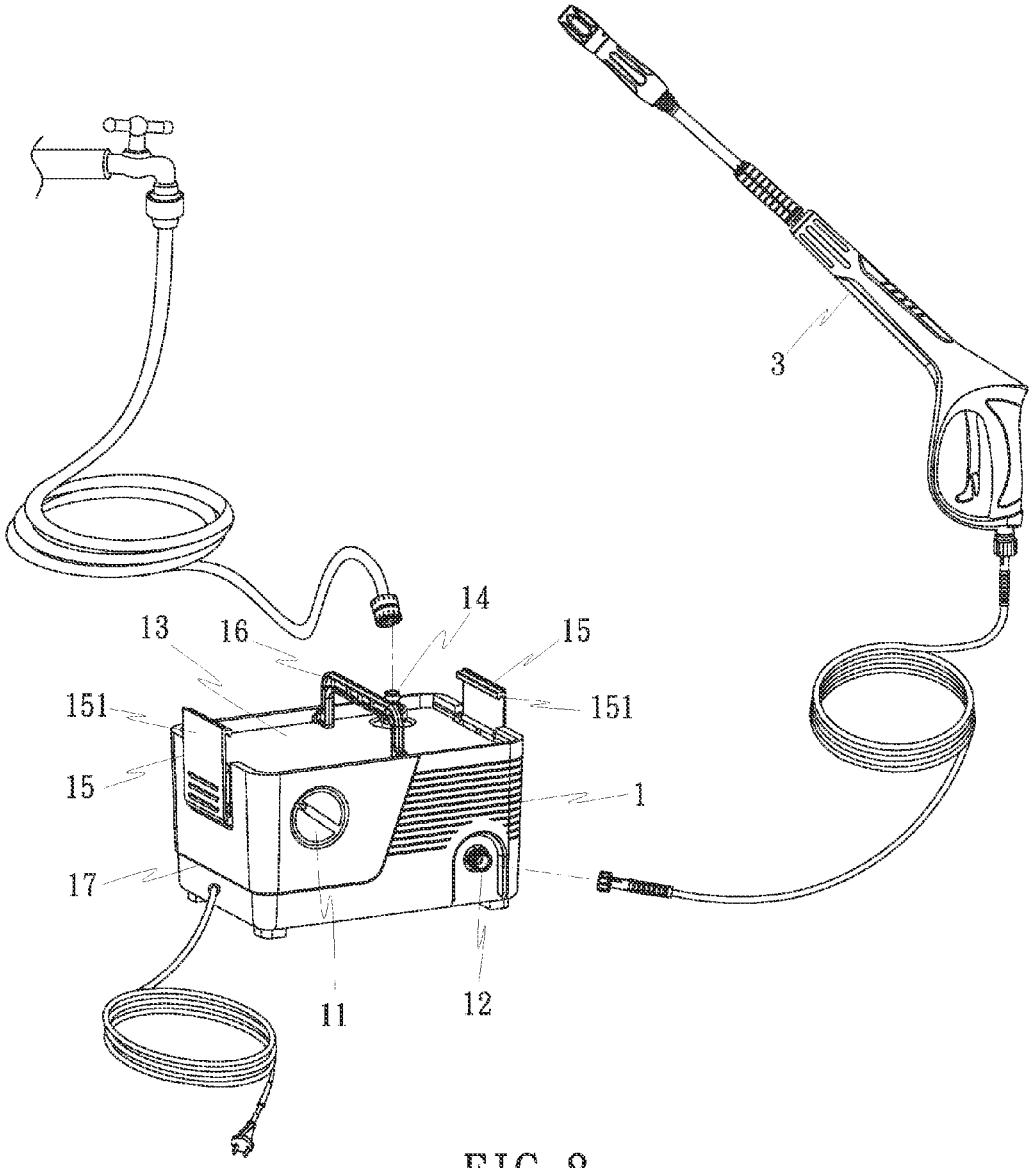
FIG. 8 is a schematic drawing of the present invention, showing another application example of the high pressure water cleaner with detachable water tank .

Referring to FIG. 8, a carrying handle 16 is pivotally connected to the receptacle 13 of the water cleaner main unit 1 to facilitate carrying by hand. The movable lock 15 according to this embodiment comprises a locking handle 151 pivotally connected to the water cleaner main unit 1. The locking handle 151 has a hook 152 at its free end for hooking on the detachable water tank 2. Further, the aforesaid electrical drive can use AC power (city power) as well as DC power. A rechargeable battery (not shown) is installed in the water cleaner main unit 1 for providing the necessary working voltage to the electrical drive. Thus, the high pressure water cleaner with detachable water tank can be used in different situations.

Referring to FIGS. 1 and 2 again, the detachable water tank 2 is detachably connected to the receptacle 13 of the water cleaner main unit 1, having a top opening 21, a check valve 22 located on the bottom side for connection to the feed water connector 14, and a retainer 23 for receiving the locking handle 151 of the movable lock 15. Thus, the detachable water tank 2 can be secured to the water cleaner main unit 1 for use with the water cleaner main unit 1, or separated from the water cleaner main unit 1 for independent application.

Figure 3:
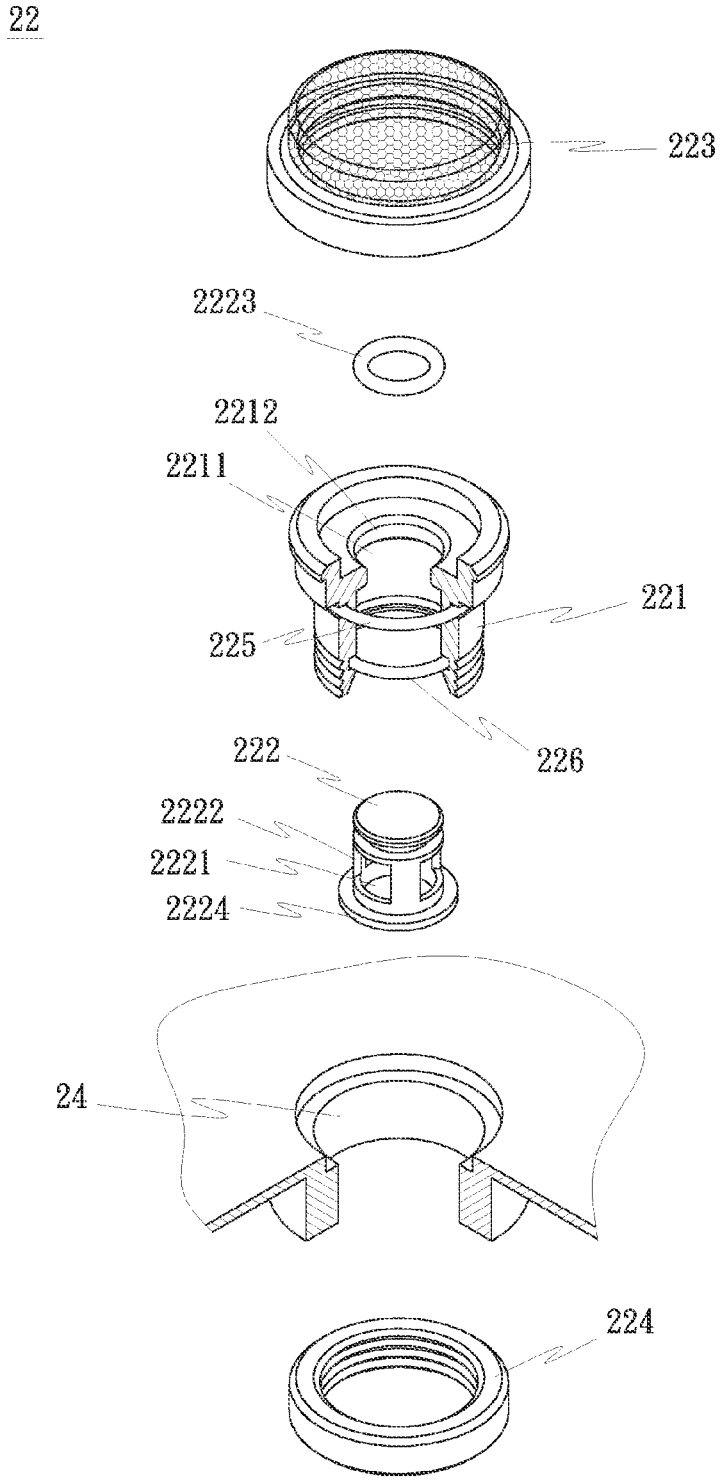
FIG. 3 is an exploded view of the check valve of the detachable water tank of the high pressure water cleaner with detachable water tank in accordance with the present invention.
Figure 4:
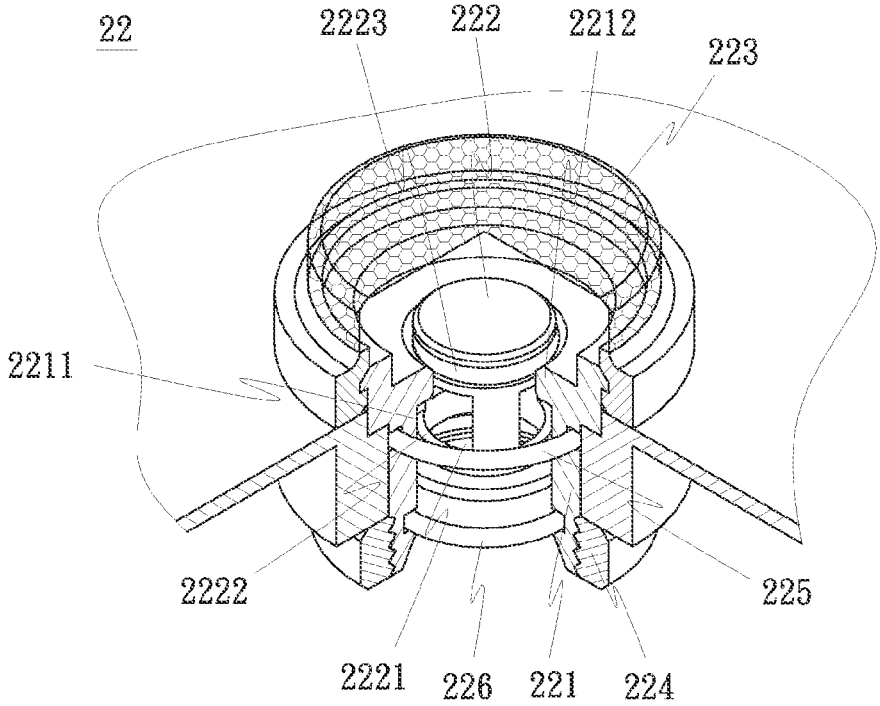
FIG. 4 is a sectional elevation of the check valve of the detachable water tank of the high pressure water cleaner with detachable water tank in accordance with the present invention.
Figure 5:
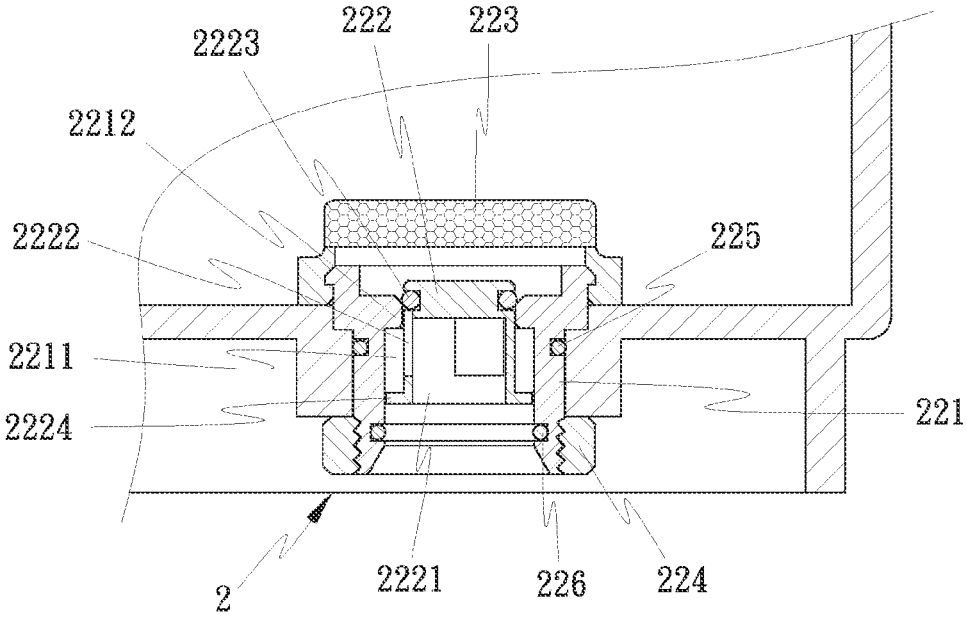
FIG. 5 is a sectional side view of the check valve of the detachable water tank of the high pressure water cleaner with detachable water tank in accordance with the present invention.
Figure 6:
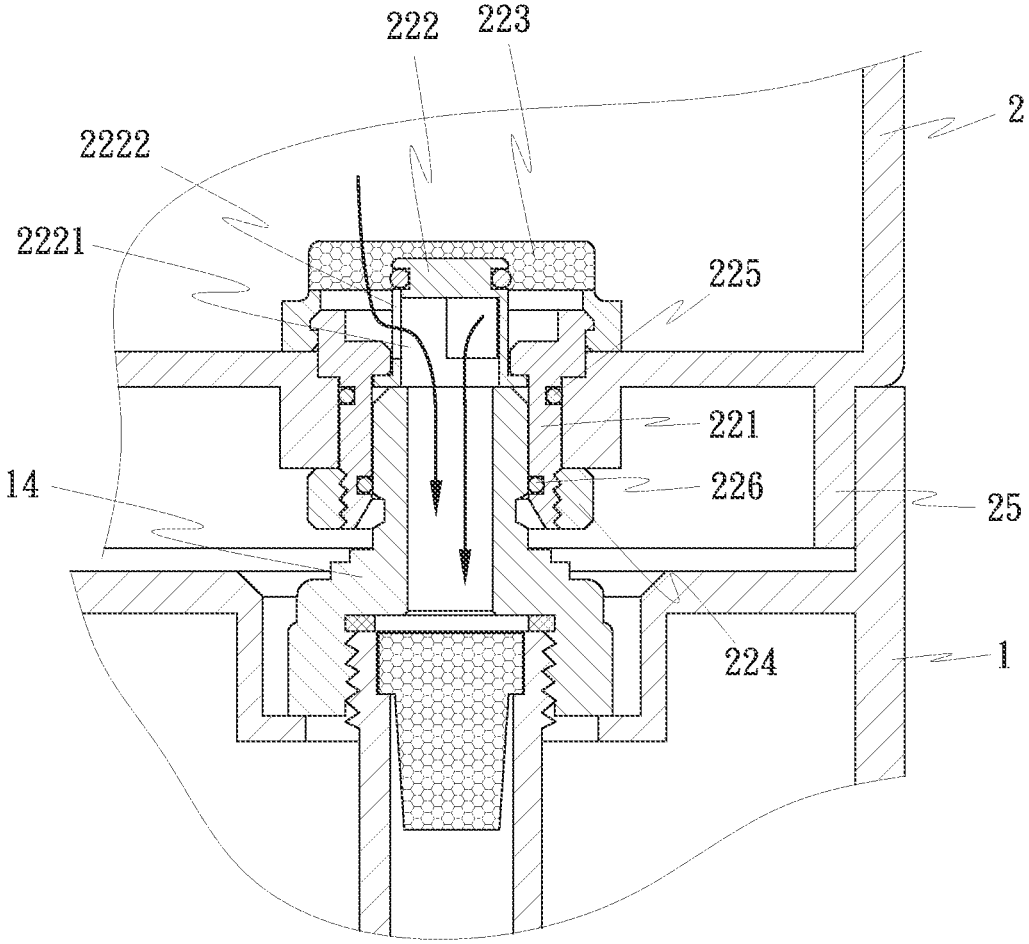
FIG. 6 is a schematic drawing of a part of the present invention, showing an operation status of the check valve.

Referring to FIGS. 3-5, the detachable water tank 2 has a drain hole 24 cut through the bottom wall thereof. The check valve 22 is installed in the drain hole 24, comprising a valve body 221, a valve hole 2211 at the center of the valve body 221 and a movable plug 222 mounted in and axially movable relative to the valve hole 2211. As shown in FIG. 6, when the valve hole 2211 of the check valve 22 is attached to the feed water connector 14, the movable plug 222 is moved relative to the valve hole 2211 to open the passage of the valve hole 2211 for allowing a cleaning solution (e.g. water) to pass from the detachable water tank 2 through the valve hole 2211 into the water cleaner main unit 1. On the contrary, when the detachable water tank 2 is removed from the water cleaner main unit 1, the movable plug 222 is returned to its former position to close the passage of the valve hole 2211, preventing the cleaning solution (water) from leaking. Thus, based on the design of the check valve 22, the detachable water tank 2 can be secured to the water cleaner main unit 1 for use with the water cleaner main unit 1, or separated from the water cleaner main unit 1 for independent application.

Referring to FIGS. 3-5 again, the check valve 22 further comprises an inside annular flange 2212 suspending in the valve hole 2211 for the passing of the movable plug 222. The movable plug 222 has a blind hole 2221 axially extending to its one end, namely, the bottom end, a plurality of radial holes 2222 disposed in communication with the blind hole 2221 and spaced around the periphery, a gasket ring 2223 fastened to the periphery near its other end, namely, the top end, and a stop flange 2224 extending around the periphery at the bottom end and stoppable at the bottom side of the inside annular flange 2212 of the valve body 221. Further, a wire gauze filter 223 is fastened to one end of the valve body 221, as shown in FIG. 6, for removing solid matters from the cleaning solution (water) passing through the check valve 22 toward the water cleaner main unit 1. A lock member, for example, lock nut 224 is fastened to the other end of the valve body 221 to lock the check valve 22 to the drain hole 24 of the detachable water tank 2. Further, in order to avoid cleaning solution leakage, one or a number of O-rings 225 are fastened to the periphery of the valve body 221 to seal the gap between the valve body 221 and the drain hole 24. A number of O-rings 226 may be fastened to the internal wall of the valve hole 221 to seal the feed water connector 14 of the water cleaner main unit 1.

Referring to FIGS. 1 and 2 again, the detachable water tank 2 has a bottom flange 25 fitting the receptacle 13 of the water cleaner main unit 1. By fitting the bottom flange 25 with the receptacle 13 of the water cleaner main unit 1, the detachable water tank 2 can be quickly coupled to the water cleaner main unit 1. The retainer 23 of the detachable water tank 2 has a recessed hole 231 for receiving the locking handle 151 of the movable lock 15, and a transverse rod 232 suspending in the recessed hole 231 for receiving the hook 152 at the free end of the locking handle 151.

Referring to FIG. 2 again, a carrying handle 26 is pivotally connected to the detachable water tank 2 at the top to facilitate carrying by hand. By means of the carrying handle 26, a user can carry the detachable water tank 2 to a water source to take water and then carry the detachable water tank 2 to the water cleaner main unit 1 for installation or to any desired place for independent application.

Figure 7:
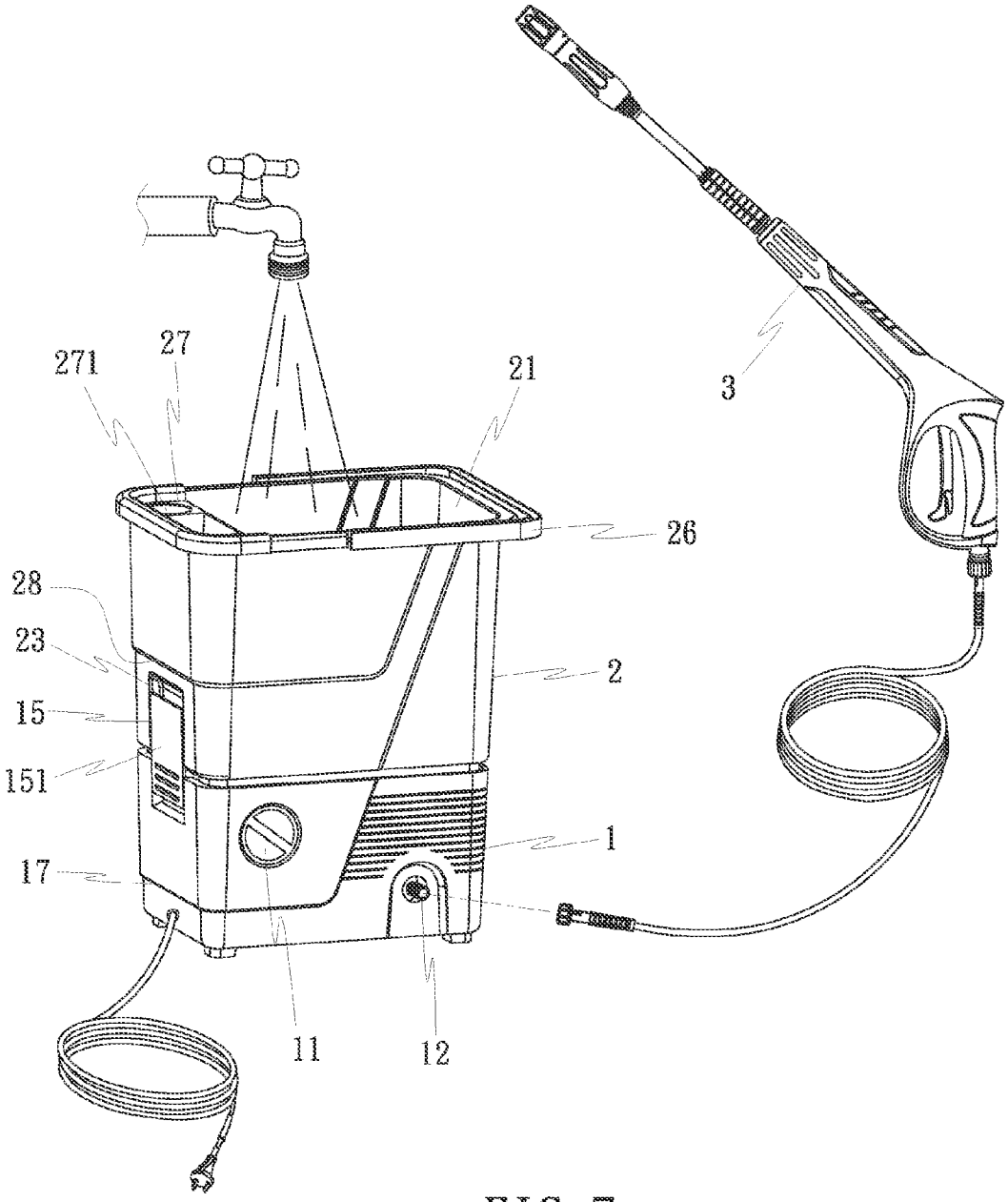
FIG. 7 is a schematic drawing of the present invention, showing an application example of the high pressure water cleaner with detachable water tank .

Referring to FIG. 7, the detachable water tank 2 has a nozzle gun rest 27 for the resting of the nozzle gun 3. The nozzle gun rest 27 has a recessed hole 271. When not in use, the nozzle gun 3 can be rested in the recessed hole 271 of the nozzle gun rest 27.

When using the high pressure water cleaner with detachable water tank, as shown in FIG. 7, the detachable water tank 2 can be installed in the water cleaner main unit 1 and moved with the water cleaner main unit 1 to a water source to take water. Alternatively, the detachable water tank 2 can be separated from the water cleaner main unit 1 and carried by hand to a water source to take water. After the detachable water tank 2 is filled up with water or other cleaning solution, it is carried to and installed in the water cleaner main unit 1. Further, as shown in FIG. 8, the water cleaner main unit 1 can be separately used. When using the water cleaner main unit 1 separately, connect the feed water connector 14 to a water source or city water tap by a hose, and then connect the nozzle gun 3 to the water outlet 12 for high pressure water cleaning. Further, the detachable water tank 2 can be separately used for holding a cleaning solution for cleaning, or for holding water for washing a cleaning tool. Thus, the high pressure water cleaner with detachable water tank meets different cleaning requirements, and eliminates the drawbacks of the prior art high pressure water cleaners.

Figure 9:
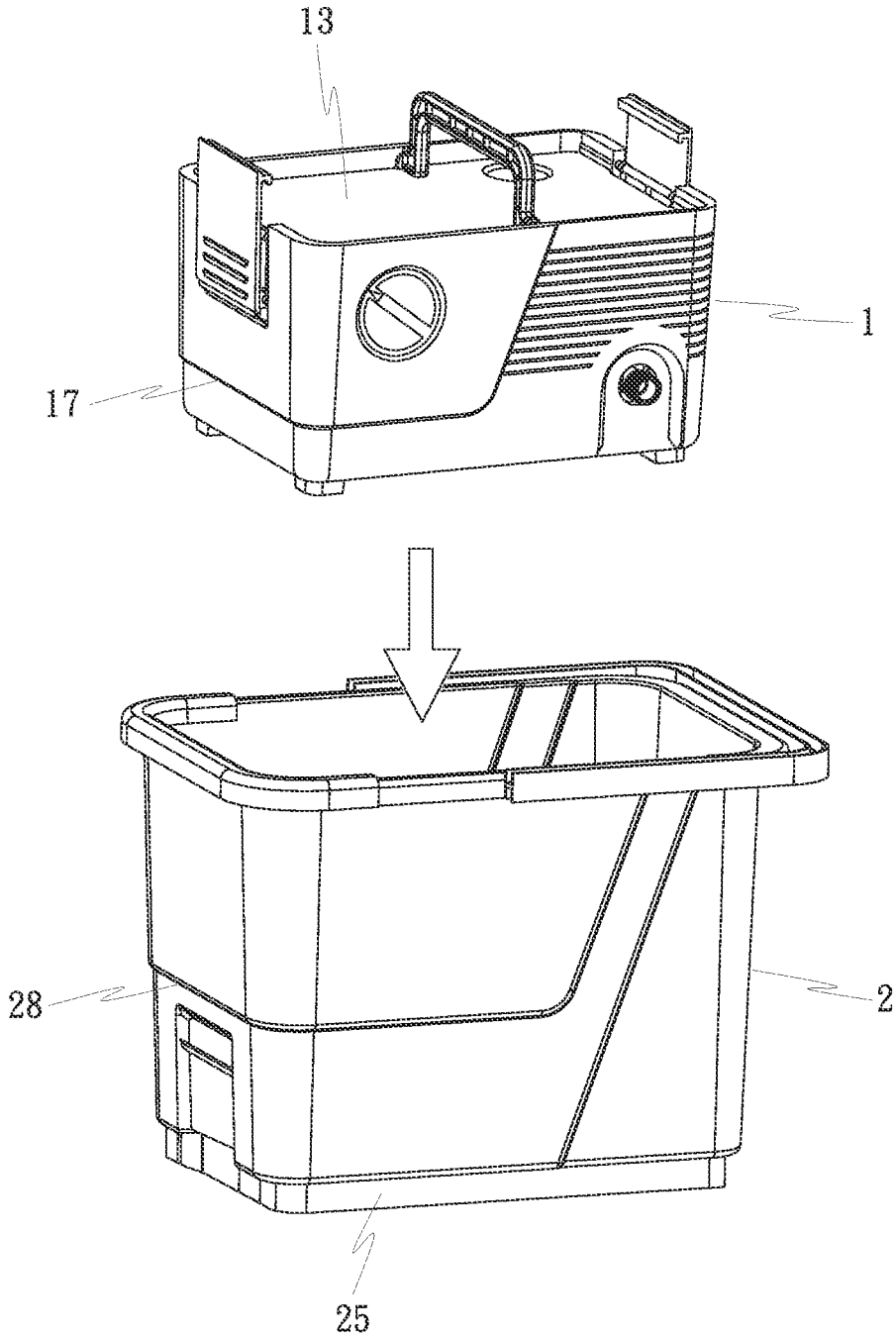
FIG. 9 illustrates a schematic drawing showing a storage status of the high pressure water cleaner with detachable water tank in accordance with the present invention.

Further, as shown in FIG. 9, when the high pressure water cleaner with detachable water tank is not used, the water cleaner main unit 1 can be received in the detachable water tank 2 to minimize storage space, thus facilitating movement and storage. Further, the water cleaner main unit 1 has a stepped structure 17 on the periphery. Further, the detachable water tank 2 has a support structure 28 located on the inside corresponding to the stepped structure 17 of the water cleaner main unit 1. When the water cleaner main unit 1 is inserted into the detachable water tank 2, the stepped structure 17 of the water cleaner main unit 1 is stopped and supported at the support structure 28. Thus, the water cleaner main unit 1 can be steadily positioned in the detachable water tank 2, Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A high pressure water cleaner with detachable water tank, comprising:

a water tank for holding water and supplying water, said water tank comprising:

a bottom wall with a periphery extending upwardly therefrom, said periphery defining a top opening; and a check valve mounted through said bottom wall; and a water cleaner main unit, said water cleaner main unit comprising:

a hydraulic pump mounted therein for enhancing the pressure of supplied water;

a regulator for regulating water pressure and water flow rate;

an electrical drive for driving said hydraulic pump;

a water outlet disposed at one lateral side thereof in communication with said hydraulic pump for connecting to a spray gun;

a receptacle located on a top side thereof for receiving said water tank;

a feed water connector upwardly protruding from a bottom wall of said receptacle and disposed in communication with said hydraulic pump, and adapted to detachably connect to said check valve for receiving water from said water tank upon insertion of said water tank into said receptacle; and a movable lock adapted for locking said water tank to said receptacle, wherein said water cleaner main unit is receivable inside said water tank through the top opening.

2. The high pressure water cleaner with detachable water tank as claimed in claim 1, wherein said movable lock comprises a locking handle pivotally connected to said water cleaner main unit and a hook located on the free end of said locking handle for hooking on said water tank.

3. The high pressure water cleaner with detachable water tank as claimed in claim 1, wherein said water tank comprises a carrying handle pivotally connected to a top edge thereof.

4. The high pressure water cleaner with detachable water tank as claimed in claim 1, wherein said feed water connector is adapted to be selectively coupled to a water hose and to said detachable water tank.

5. The high pressure water cleaner with detachable water tank as claimed in claim 1, wherein said electrical drive consumes either one of AC power or DC power.

6. The high pressure water cleaner with detachable water tank as claimed in claim 5, wherein said water cleaner main unit further comprises a rechargeable battery mounted therein and electrically connected to said electrical drive.

7. The high pressure water cleaner with detachable water tank as claimed in claim 1, wherein said water tank further comprises a retainer located on the periphery for engaging said movable lock.

8. The high pressure water cleaner with detachable water tank as claimed in claim 7, wherein said water tank further comprises a bottom flange fitting to said receptacle of said water cleaner main unit.

9. The high pressure water cleaner with detachable water tank as claimed in claim 7, wherein said water tank further comprises a carrying handle pivotally connected to a top edge thereof.

10. The high pressure water cleaner with detachable water tank as claimed in claim 7, wherein said water cleaner main unit comprises a stepped structure located on its periphery.

11. The high pressure water cleaner with detachable water tank as claimed in claim 7, wherein said water tank comprises a drain hole located on the bottom side thereof; said check valve is installed in said drain hole, comprising a valve body, a valve hole located on the center of said valve body, and a movable plug mounted in said valve hole and axially movable relative to said valve body between a closed position to close said valve hole and an open position to open said valve hole.

12. The high pressure water cleaner with detachable water tank as claimed in claim 11, wherein said check valve further comprises an inside annular flange suspending in said valve hole for the passing of said movable plug; said movable plug has a blind hole axially extending to a bottom end thereof, a plurality of radial holes disposed in communication with said blind hole and spaced around the periphery, a gasket ring fastened to the periphery near a top end thereof, and a stop flange extending around the periphery at the bottom end thereof and stoppable at a bottom side of said inside annular flange of said valve body.

13. The high pressure water cleaner with detachable water tank as claimed in claim 11, wherein said check valve further comprises a wire gauze filter fastened to one end of said valve body and a lock member to an opposite end of said valve body to lock said check valve to said drain hole of said water tank.

14. The high pressure water cleaner with detachable water tank as claimed in claim 7, wherein said retainer of said detachable water tank has a recessed hole for receiving said movable lock, and a transverse rod suspending in said recessed hole for engaging of said movable lock.

15. The high pressure water cleaner with detachable water tank as claimed in claim 14, wherein said movable lock comprises a locking handle pivotally connected to said water cleaner main unit and a hook located on the free end of said locking handle for hooking on said transverse rod of said retainer of said water tank.

16. The high pressure water cleaner with detachable water tank as claimed in claim 10, wherein said water tank comprises a stepped structure in its periphery, said stepped structure being configured to correspond to said stepped structure located on said periphery of said water cleaner main unit to support said water cleaner main unit when said water cleaner main unit is received inside said water tank.

17. The high pressure water cleaner with detachable water tank as claimed in claim 7, wherein said water tank further comprises a nozzle gun rest for receiving a nozzle gun.

18. The high pressure water cleaner with detachable water tank as claimed in claim 17, wherein said nozzle gun rest has a recessed hole for receiving said nozzle gun.

* * * * *